US005605234A

United States Patent [19]

Aikawa

[11] Patent Number: 5,605,234

[45] Date of Patent: Feb. 25, 1997

[54] PAPER MAKING SCREEN PLATE

[75] Inventor: Yoshihiko Aikawa, Shizuoka, Japan

[73] Assignee: Aikawa Iron Works Co., Ltd., Shizuoka, Japan

[21] Appl. No.: 503,090

[22] Filed: Jul. 17, 1995

[30] Foreign Application Priority Data

Jan. 27, 1995 [JP] Japan ..... 7-011868

[51] Int. Cl.[6] ..... B07B 1/49

[52] U.S. Cl. ..... 209/411; 209/395; 210/485

[58] Field of Search ..... 209/273, 281, 209/283, 300, 305, 306, 363, 393, 395, 405, 406, 409, 410, 411; 210/413, 485, 497.01; 29/163.6, 163.7, 163.8

[56] References Cited

U.S. PATENT DOCUMENTS

| | | | |
|---|---|---|---|
| 5,011,065 | 4/1991 | Musselmann | 209/411 X |
| 5,041,212 | 8/1991 | Gero et al. | 209/305 X |
| 5,094,360 | 3/1992 | Lange | 209/411 X |

FOREIGN PATENT DOCUMENTS 6299490 10/1994 Japan .

*Primary Examiner*—William E. Terrell

*Assistant Examiner*—Tuan Nguyen

*Attorney, Agent, or Firm*—Kanesaka & Takeuchi

[57] ABSTRACT

A paper making screen plate 1 includes first and second support members 31, 32, a plurality of longitudinal members 33 each having an end fixed to the first support member 31 and the other end fixed to the second support member 32, respectively and annularly disposed parallel with each other with gaps t defined therebetween, an intermediate support member 35 interposed between the first support member 31 and the second support member 32, having openings 36 for causing the longitudinal members 33 to pass therethrough and supporting the longitudinal members 33 by being abutted thereagainst, a first interval keeping member 381 having an end abutted against the first support member 31 and the other end abutted against the intermediate support member 35, respectively, and a second interval keeping member 391 having an end abutted against the intermediate support member 35 and the other end abutted against the second support member 32, respectively. The first interval keeping member 381 and the second interval keeping member 391 hold the intermediate support member 35 therebetween to thereby regulate the movement thereof. With this arrangement, a paper making screen plate having an excellent performance and capable of easily replacing the longitudinal members can be provided.

5 Claims, 7 Drawing Sheets

PAPER MAKING SCREEN PLATE

BACKGROUND OF THE INVENTION

1. Field of the Invention

The present invention relates to a paper making screen plate, and more specifically, to a paper making screen plate which makes use of gaps as slits, the gaps being defined by longitudinal members disposing in parallel with each other.

2. Description of the Related Art

The applicant discloses a paper making screen plate having gaps defined by longitudinal members (bar-shaped members) disposed near to each other in Japanese Patent Publication Laid-Open No. 6(1994)-299490.

The paper making screen plate disclosed in the publication includes longitudinal members (bar-shaped members) each having a circular cross section, a first support member having receiving portions for the longitudinal members (the bar-shaped members) which are annularly formed thereto at intervals and a second support member having receiving portions for the longitudinal members (the bar-shaped members) which are annularly formed thereto at intervals. The ends of the longitudinal members (the bar-shaped members) on one side of the screen plate are abutted against the receiving portions of the first support member, the ends of the longitudinal members (the bar-shaped members) on the other side are abutted against the receiving portions of the second support member, respectively, and the abutted portions are fixed by welding.

When the longitudinal members (bar-shaped members) are made to a relatively long size,. since the rigidity of the longitudinal members (bar-shaped members) cannot be kept only by the first support member and the second support member, a third support member is disposed at a suitable location of the bar-shaped members and fixed thereto by welding.

In the aforesaid paper making screen plate, since the ends of the longitudinal members (the bar-shaped members) on one side of the screen plate are abutted against the receiving portions of the first support member, the ends of the longitudinal members (the bar-shaped members) on the other side are abutted against the receiving portions of the second support member and the abutted portions are fixed by welding, the longitudinal members (bar-shaped members) are deformed by thermal stress and the like.

Moreover, since the longitudinal members (bar-shaped members) are fixed to the third support member by welding at the intermediate portions thereof, a problem arises in that an amount of deformation is further increased and the gaps defined between the longitudinal members (bar-shaped members) cannot be kept constant and thus the performance of the screen plate is lowered.

In addition, there is also a problem that when one of the longitudinal members (bar-shaped members) is damaged in the state that the screen plate is used by being assembled to a screen, since the longitudinal member (bar-shaped member) is fixed by welding in the intermediate portion thereof, it is very time-consuming to replace the damaged longitudinal member (bar-shaped member).

An object of the present invention is to provide a paper making screen plate arranged to remove the aforesaid conventional problems.

SUMMARY OF THE INVENTION

To achieve the above problem, a paper making screen plate of the present invention comprises first and second support members, a plurality of longitudinal members each having an end fixed to the first support member and the other end fixed to the second support member, respectively and annularly disposed in parallel with each other with gaps defined therebetween, an intermediate support member interposed between the first support member and the second support member, having openings for causing the longitudinal members to pass therethrough and supporting the longitudinal members by being abutted thereagainst, a first interval keeping member having an end abutted against the first support member and the other end abutted against the intermediate support member, respectively, and a second interval keeping member having an end abutted against the intermediate support member and the other end abutted against the second support member, respectively, wherein the first interval keeping member and the second interval keeping member hold the intermediate support member therebetween to thereby regulate the movement of the intermediate support member.

Further, a paper making screen plate of the present invention comprises first and second support members, a plurality of longitudinal members each having an end fixed to the first support member and the other end fixed to the second support member, respectively and annularly disposed in parallel with each other with gaps defined therebetween, first and second intermediate support members interposed between the first support member and the second support member, having openings for causing the longitudinal members to pass therethrough and supporting the longitudinal members by being abutted thereagainst, a first interval keeping member having an end abutted against the first support member and the other end abutted against the first intermediate support member, a third interval keeping member having an end abutted against the first intermediate support member and the other end abutted against the second intermediate support member, and a second interval keeping member having an end abutted against the second intermediate support member and the other end abutted against the second support member, wherein the first interval keeping member and the third interval keeping member hold the first intermediate support member therebetween and the third interval keeping member and the second interval keeping member hold the second intermediate support member, respectively to thereby regulate the movement of the first intermediate support member and the movement of the second intermediate support member.

A paper making screen plate of the present invention comprises first and second support members, a plurality of longitudinal members each having an end fixed to the first support member and the other end fixed to the second support member, respectively and annularly disposed in parallel with each other with gaps defined therebetween, n pieces ($n \geqq 3$) of intermediate support members positioned between the first support member and the second support member, having openings for causing the longitudinal members to pass therethrough and supporting the longitudinal members by being abutted thereagainst as well as sequentially disposed from the first support member side, a first interval keeping member having an end abutted against the first support member and the other end abutted against the intermediate support member next to the first support member, a second interval keeping member having an end abutted against the first support member and the other end abutted against the intermediate support member next to the second support member, and (n−1) pieces of intermediate interval keeping members each having an end abutted against the intermediate support member and the other end abutted against the intermediate support member next to the-said intermediate support member, wherein the first interval keeping member, the (n–1) pieces of the intermediate interval keeping members and the second interval keeping member support the n pieces (n≧3) of the intermediate support members to thereby regulate the movement thereof.

A paper making screen plate of the present invention is arranged such that the paper making screen plate according to a first aspect is combined with the arrangement that an end of the first interval keeping member is engaged with the recess of the first support member and the other end thereof is engaged with the recess of the intermediate support member and an end of the second interval keeping member is engaged with the recess of the second support members and the other end thereof is engaged with the recess of said intermediate support member, respectively.

Further, a paper making screen plate of the present invention is arranged such that the paper making screen plate according to a second aspect is combined with the arrangement that an end of the first interval keeping member is engaged with the recess of the first support member and the other end thereof is engaged with the recess of the first intermediate support member, an end of the second interval keeping member is engaged with the recess of the first intermediate support member and the other end thereof is engaged with the recess of the second intermediate support member, and an end of the third interval keeping member is engaged with the recess of the second intermediate support member and the other end thereof is engaged with the recess of the second support member, respectively.

Since the paper making screen plates according to the first to third aspect are arranged to hold the intermediate support member(s) between the first support member and the second support member and the longitudinal members are not fixed to the intermediate support member(s) as they were fixed thereto by welding conventionally, thermal deformation caused by welding can be prevented and gaps (slits, openings) defined between the longitudinal members can be uniformly distributed.

Further, when one of the longitudinal members is damaged in the state that the paper making screen plate is used by being assembled to a screen, a job for replacing the longitudinal member can be easily carried out when the fixed state of the both ends of the longitudinal member is released to make it free because the intermediate support member(s) is held between the first support member and the second support member and the longitudinal members are not fixed to the intermediate support member(s) by welding as they were fixed thereto by welding conventionally.

DESCRIPTION OF PREFERRED EMBODIMENTS

Figure 1:
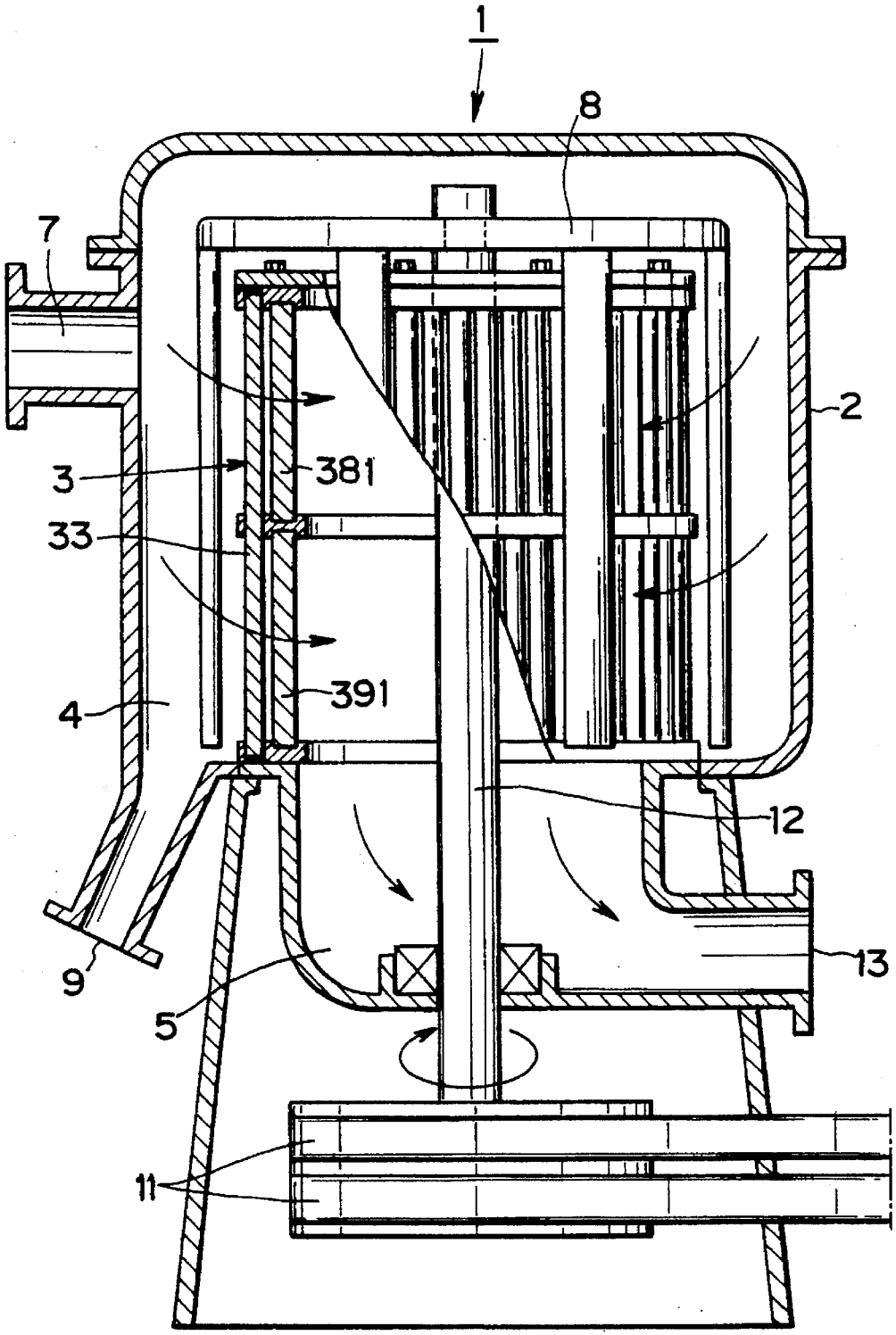
FIG. 1 is a schematic cross sectional view of a screen containing a paper making screen plate of an embodiment of the present invention.

An embodiment of the present invention will be described with reference to the drawings. In FIG. 1 to FIG. 6, numeral 1 denotes a pressure type screen which is referred to as an inward flow screen for causing a paper making material to flow from the outside of a screen plate 3 toward the inside thereof for refining. The screen 1 has a casing 2 the interior of which is schematically partitioned to a primary chamber 4 and a secondary chamber 5 by the screen plate 3.

The primary chamber 4 includes a paper making material inlet 7 for receiving a paper making material such as pulp, used paper and the like into the casing 2, a stirring member 8 for stirring the paper making material and a foreign substance outlet 9 for discharging foreign substances to the outside of the casing, each being disposed in the primary chamber 4, respectively.

The stirring member 8 is rotated by the rotation of a motor (not shown) which is transmitted to a rotary shaft 12 through belts 11.

Note, numeral 13 denotes a paper making material outlet for discharging a refined paper making material to the outside of the casing 2 and the paper making material outlet 13 confronts the interior of the secondary chamber 5.

Figure 2:
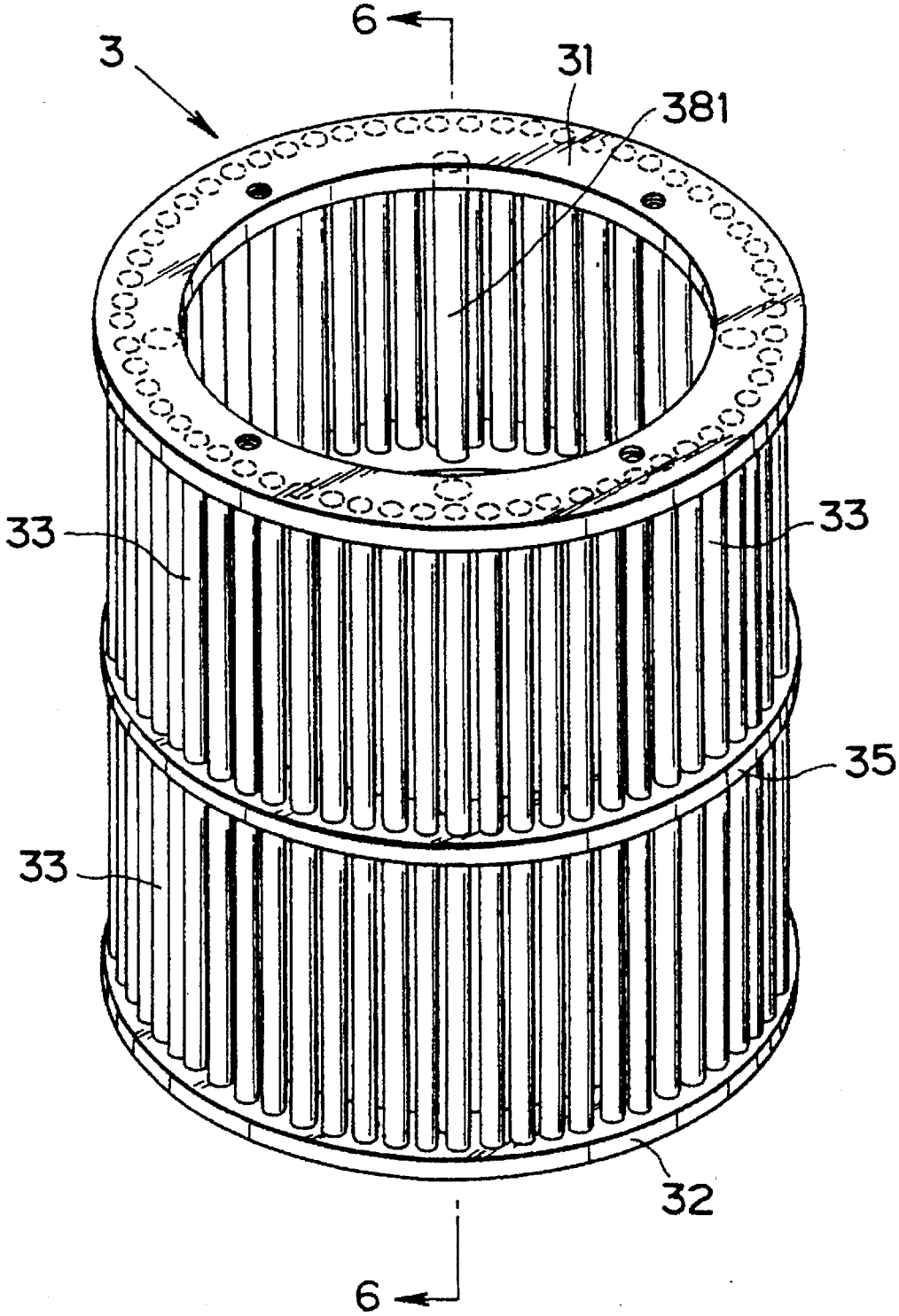
FIG. 2 is a schematic perspective view of the paper making screen plate of FIG. 1.

As shown in FIG. 2, the screen plate 3 has a first support member 31 disposed on the upper side (one side) thereof and a second support member 32 disposed on the lower side (the other side) thereof.

Each of the first support member 31 and the second support member 32 is formed to, for example, an approximately circular shape and the inside portion thereof is removed except a section having a certain width from the outside periphery thereof.

Numeral 33 denotes longitudinal members made of stainless steel or steel and each of which has, for example, a length of about 150 mm–about 2500 mm and a circular cross section (a diameter of the circle is determined by a length of fibers in the paper making material and usually has a diameter of, for example, about 2.5 mm–about 6.0 mm to prevent a phenomenon that the fibers extend over the longitudinal members 33).

Figure 3:
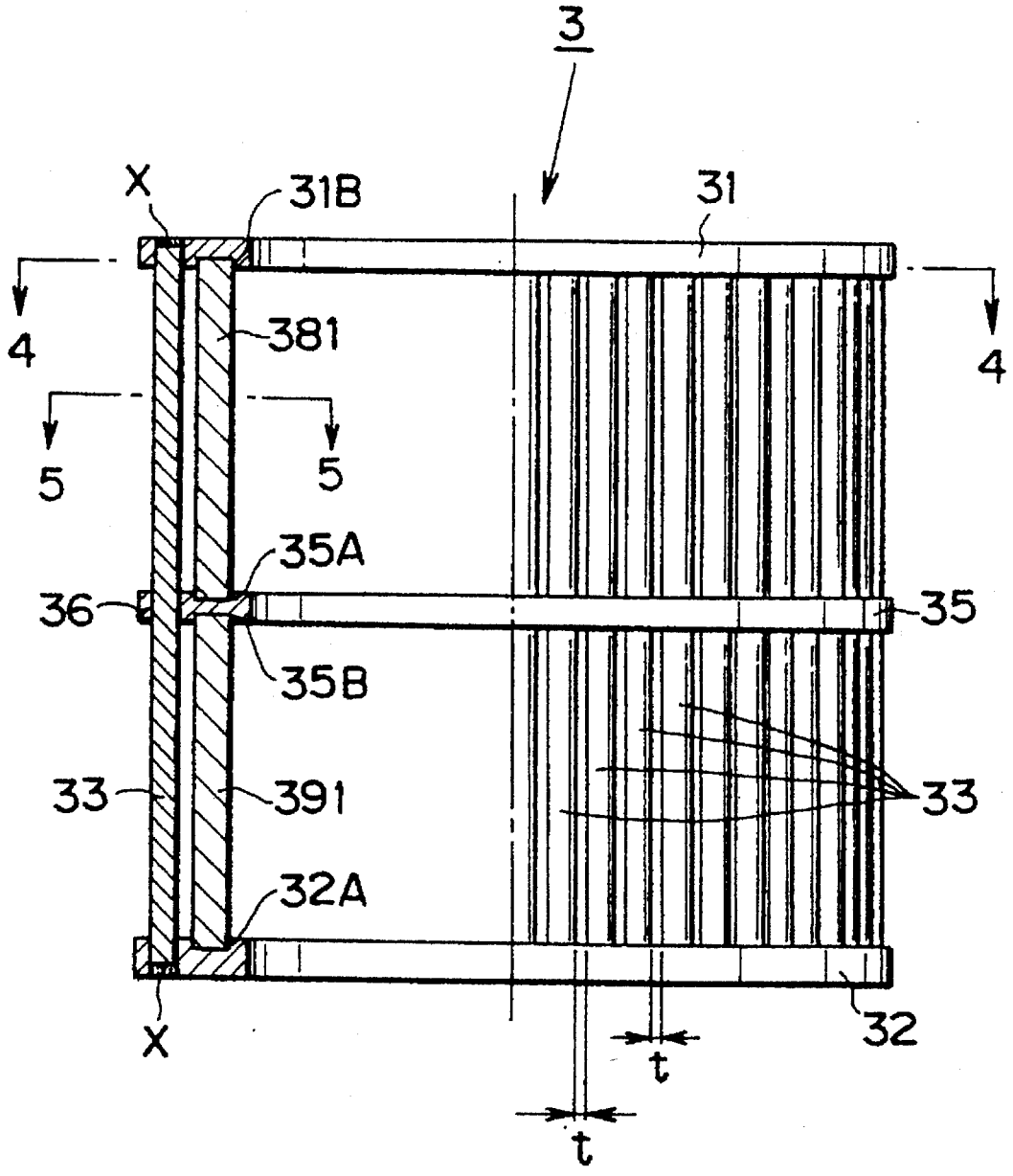
FIG. 3 is a schematic side elevational view, partly in cross section, of the paper making screen plate of FIG. 1.
Figure 6:
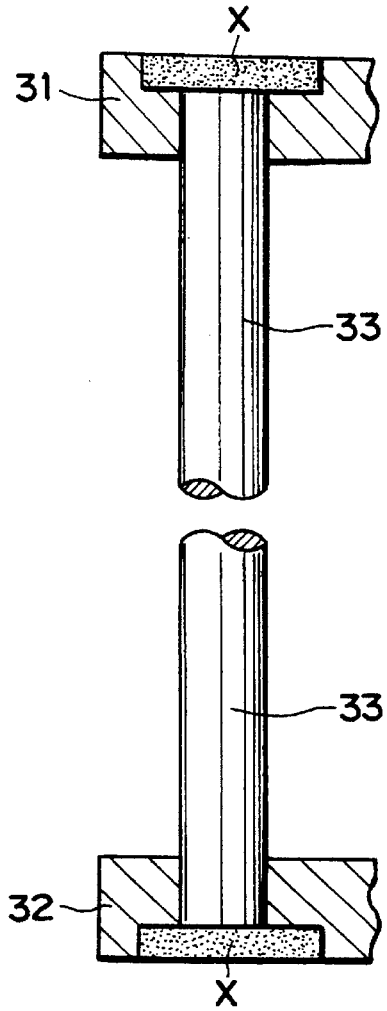
FIG. 6 is a schematic cross sectional view taken along line 6—6 of FIG. 2.

Further, as shown in FIG. 3, an end of each longitudinal member 33 is fixed to the first support member 31 and the other end thereof is fixed to the second support member 32, respectively by, for example, welding (the fixed portions are shown by symbols X in FIG. 3 and FIG. 6). These longitudinal members 33 are annularly disposed in parallel with each other with gaps t defined therebetween.

Note, the fixed portions are shown by the symbols X as apparent from FIG. 6, an end of the longitudinal member 33 is fixed to the support member 31 by welding and the other end thereof is also fixed to the support member 32 by welding likewise.

Figure 5:
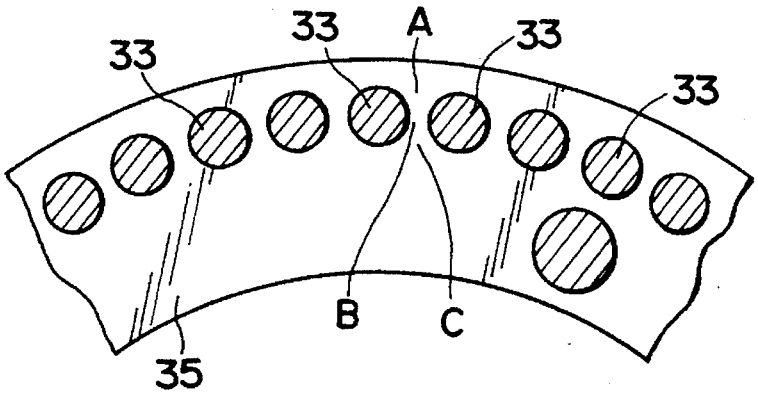
FIG. 5 is a schematic cross sectional view taken along line 5—5 of FIG. 3.

As a result that the longitudinal members 33 are disposed in parallel with each other, the inlet A and outlet C of the longitudinal members 33 are widely formed as compared with the intermediate portion B thereof as shown in an enlarged section in FIG. 5.

The gap t has a size determined depending upon the size of foreign substances contained in the paper making material and is set to, for example, about 2 mm–about 0.50 mm.

Although the both ends of the longitudinal members 33 are fixed to the first support member 31 and the second support member 32, respectively, since the longitudinal members 33 are long in a longitudinal direction and do not, have rigidity, the longitudinal members are supported by intermediate support members 35 at the intermediate portions thereof so as to increase the rigidity thereof (the intermediate support members 35 are positioned at intervals of, for example, 75 mm or 200 mm in the longitudinal direction of the longitudinal members 33).

The intermediate support members 35 are interposed between the first support member 31 and the second support member 32, have openings 36 for causing the longitudinal members 33 to pass therethrough and support the longitudinal members 33 by being abutted thereagainst at the openings 36.

Figure 4:
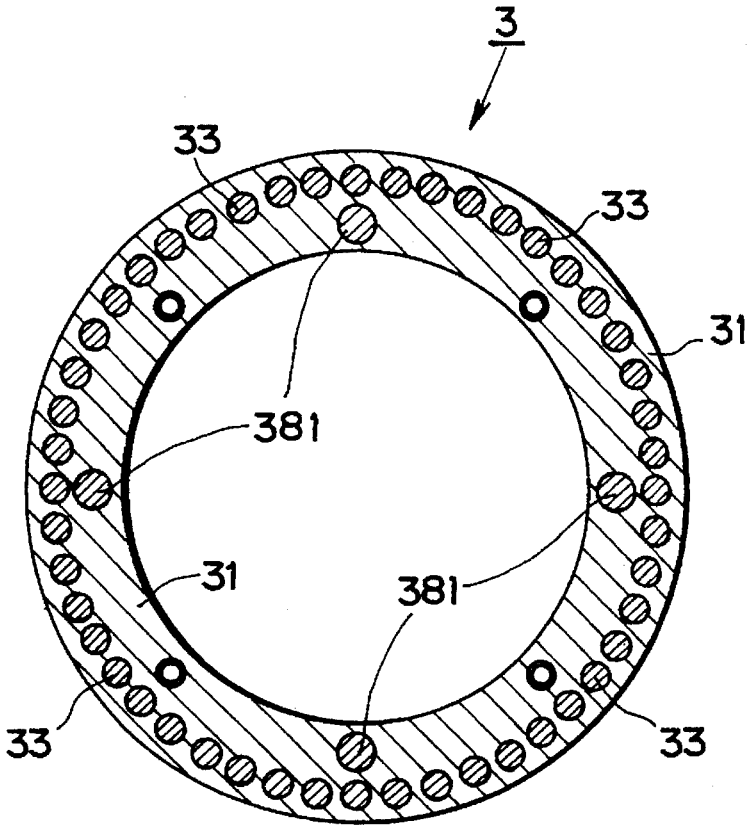
FIG. 4 is a schematic cross sectional view taken along the line 4—4 of FIG. 3.

A first interval keeping member 381 is interposed between the first support member 31 and the intermediate support member 35 and a second interval keeping member 391 is interposed between the second support member 32 and the intermediate support member 35, respectively. As shown in FIG. 4, a plurality of the first interval keeping members 381 (for example, 4 pieces) are disposed at predetermined intervals and a plurality of the second interval keeping members 391 (for example, 4 pieces) are also disposed at predetermined intervals likewise. These first interval keeping members 381 and second interval keeping members 391 are formed of stainless steel, steel, duracon resin or the like.

An end of the first interval keeping member 381 is abutted against the first support member 31 and the other end thereof is abutted against the intermediate support member 35, respectively.

Further, an end of the second interval keeping member 391 is abutted against the intermediate support member 35 and the other end thereof is abutted against the second support member 32, respectively.

To more surely achieve the abutted state, a recess 31B is formed to the first support member 31, a recess 35A is formed to the intermediate support member 35 on the first support member 31 side thereof, a recess 35B is formed to the intermediate support member 35 on the second support member 32 side thereof, and a recess 32A is formed to the second support member 32, respectively. Then, an end of the first interval keeping member 381 is engaged with the recess 31B of the first support member 31, the other end thereof is engaged with the recess 35A of the intermediate support member 35, an end of the second interval keeping member 391 is engaged with the recess 32A of the second support member 32 and the other end thereof is engaged with the recess 35B of the intermediate support member 35, respectively.

Note, a plurality of the recesses 31B, recesses 35A, recesses 35B and recesses 32A are formed in correspondence with the first interval keeping members 381 and second interval keeping members 391.

As a result, the first interval keeping member 381 and the second interval keeping member 391 hold the intermediate support member 35 therebetween to thereby regulate the movement of the intermediate support member 35.

Therefore, according to this embodiment, since the intermediate support member 35 is held between the first interval keeping member 381 and the second interval keeping member 391 and the longitudinal members 33 are not fixed to the intermediate support member 35 by welding as they were fixed thereto be welding conventionally, thermal deformation caused by welding can be prevented and the gaps t (slits, openings) defined between the longitudinal members 33 can be uniformly distributed so that a paper making screen plate 3 having an excellent performance can be obtained. Further, when one of the longitudinal members 33 is damaged in the state that the paper making screen plate 3 is used by being assembled to the screen 1, a job for replacing the longitudinal member 33 can be easily carried out because the intermediate support member 35 is held between the first interval keeping member 381 and the second interval keeping member 391 and the longitudinal members 33 are not fixed to the intermediate support member 35 by welding as they were fixed thereto by welding conventionally.

Figure 7:
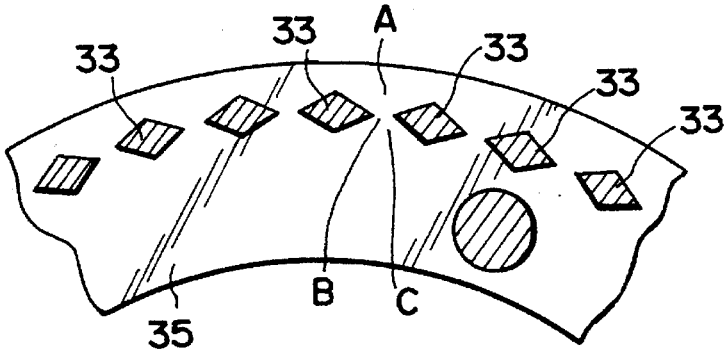
FIG. 7 is a schematic cross sectional view showing another embodiment different from that shown in FIG. 5.

Note, although the longitudinal member 33 is formed to have the circular cross section as shown in FIG. 4, it is not limited to the circular cross section but may be formed to a polygonal cross section as shown in FIG. 7.

Figure 8:
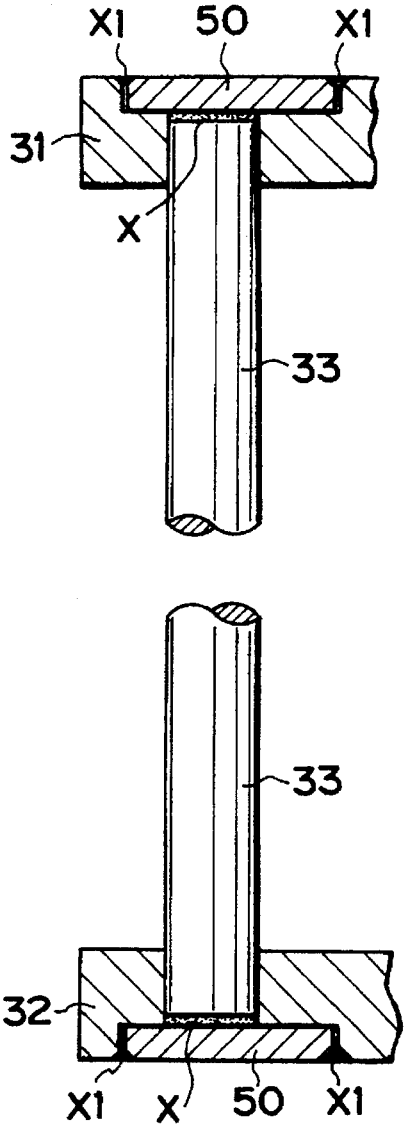
FIG. 8 is a schematic cross sectional view showing another embodiment different from that shown in FIG. 6.

Although an end of the longitudinal member 33 is fixed to the first support member 31 and the other end thereof is fixed to the second support member 32 by welding, respectively as shown in FIG. 6, it may be possible as shown in FIG. 8 that an end of the longitudinal member 33 is fixed to the first support member 31 and the other end thereof is fixed to the second longitudinal member 32 by welding, respectively (the fixed portions are shown by symbols X in FIG. 8) and members 50 are abutted against the welded surfaces and fixed to the first support member 31 and the second support member 32 by welding, respectively (the fixed portions are shown by symbols X1) in order to reduce an amount of welding.

Figure 9:
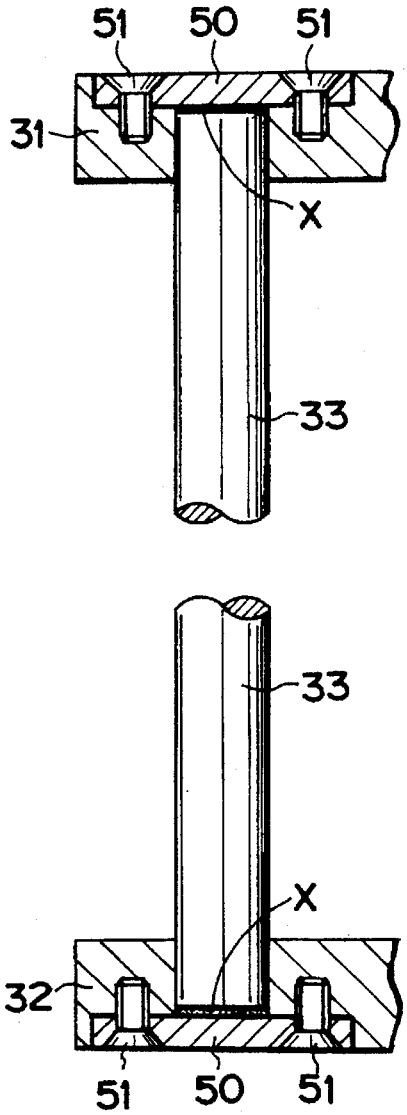
FIG. 9 is a schematic cross sectional view showing another embodiment different from that shown in FIG. 8.

Further, as shown in FIG. 9, means for fixing the members 50 to the first support member 31 and the second support member 32 is not limited to welding but screws 51, for example, may be employed.

Figure 10:
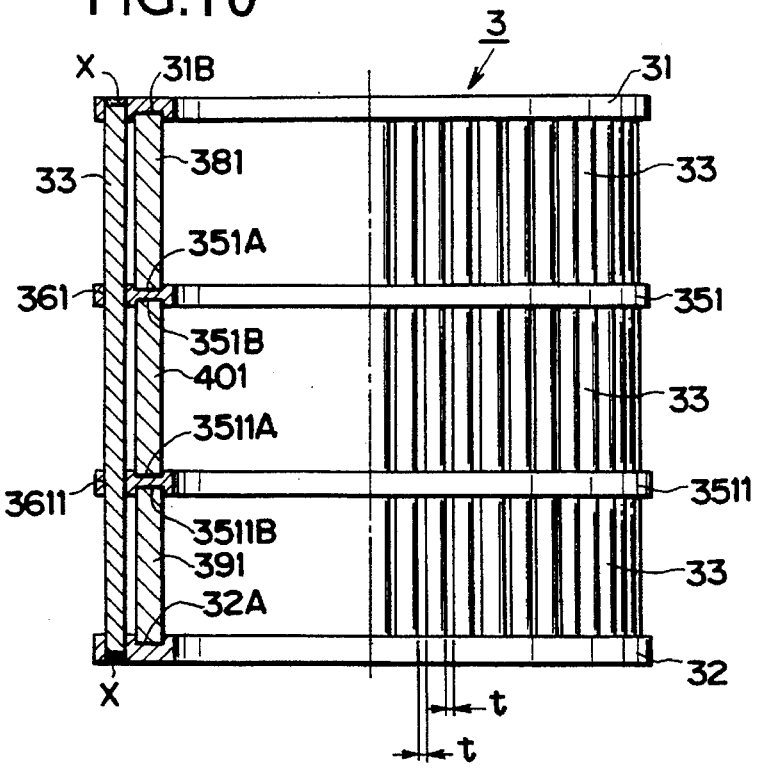
FIG. 10 is a schematic side cross sectional view, partly in cross section, showing a paper making screen plate different from that of FIG. 3.
Figure 11:
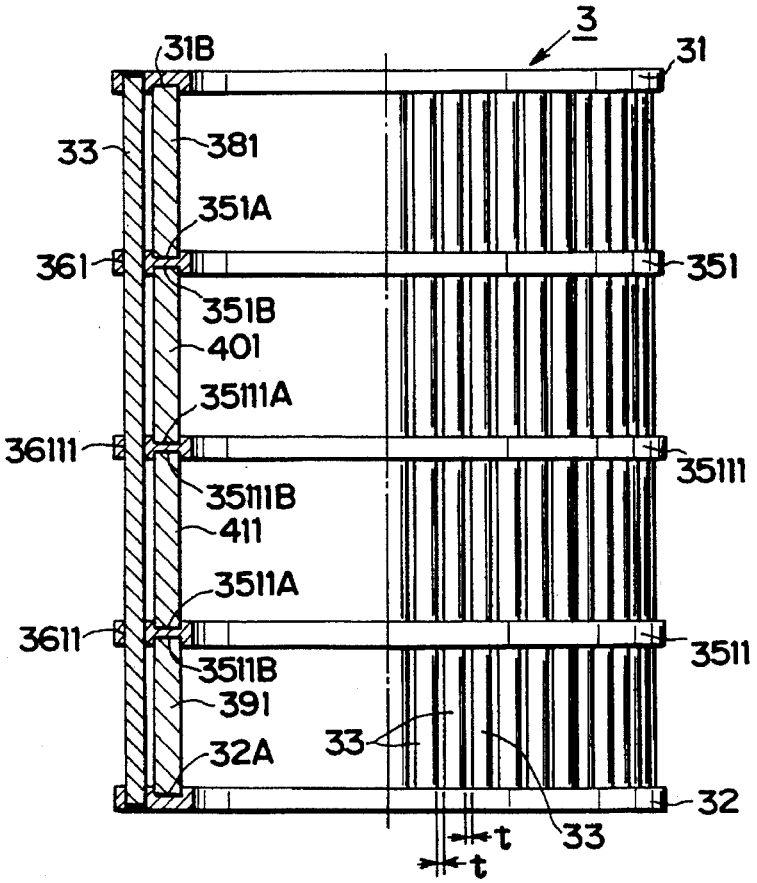
FIG. 11 is a schematic side cross sectional view, partly in cross section, showing a paper making screen plate different from that of FIG. 10.

Further, a single piece of the intermediate support member 35 is used in the aforesaid embodiment, but a plurality of the intermediate support members 35 may be used as shown in FIG. 10 and FIG. 11.

That is, first and second intermediate support members 351, 3511 are interposed between the first support member 31 and the second support member 32, have openings 361, 3611 to cause the longitudinal members 33 to pass therethrough and support the longitudinal members 33 by being abutted thereagainst in FIG. 10.

The longitudinal members 33 are fixed to the first support member 31 at an end thereof and to the second support member 32 at the other end thereof by welding or the like, respectively and annularly disposed parallel with each other with gaps t defined therebetween.

A first interval keeping member 381 is interposed between the first support member 31 and the first intermediate support member 351, a third interval keeping member 401 is interposed between the first intermediate support member 351 and the second intermediate support member 3511 and the second interval keeping member 391 is interposed between the second intermediate support member 3511 and the second support member 32, respectively.

Note, a plurality (for example, 4 pieces) of the first interval keeping members 381 are disposed at intervals as shown in FIG. 4 and a plurality (for example, 4 pieces) of the second interval keeping members 391 and the third interval keeping members 401 are also disposed at predetermined intervals likewise.

To more surely achieve the abutted state, the recess 31B is formed to the first support member 31, a recess 351A is formed to the first intermediate support member 351 on the first support member 31 side thereof, a recess 351B is formed to the first intermediate support member 351 on the side thereof opposite to the recess 351A, a recess 3511A is formed to the second intermediate support member 3511, a recess 3511B is formed to the second intermediate support member 3511 on the side opposite to the recess 3511A and the recess 32A is formed to the second support member 32, respectively.

Note, a plurality of the recesses 31B, recesses 351A, recesses 351B, recesses 3511A, recesses 3511B and recesses 32A are formed in correspondence with the first interval keeping members 381, second interval keeping members 391 and the third interval keeping members 401.

An end of the first interval keeping member 381 is engaged with the recess 31B of the first support member 31 and the other end thereof is engaged with the recess 351A of the first intermediate support member 351, an end of the third interval keeping member 401 is engaged with the recess 351B of the first intermediate support member 351 and the other end thereof is engaged with the recess 3511A of the second intermediate support member 3511, and an end of the second interval keeping member 391 is engaged with the recess 3511B of the second intermediate support member 3511 and the other end thereof is engaged with the recess 32A of the second support member 32, respectively.

As a result, the first interval keeping member 381 and the third interval keeping member 401 hold the first intermediate support member 351 therebetween and the third interval keeping member 401 and the second interval keeping member 391 hold the second intermediate support member 3511 therebetween, respectively to thereby regulate the movement of the first intermediate support member 351 and the second intermediate support member 3511.

Therefore, according to this embodiment, since the first interval keeping member 381 and the third interval keeping member 401 hold the first intermediate support member 351 therebetween and the third interval keeping member 401 and the second interval keeping member 391 hold the second intermediate support member 3511 therebetween, respectively and the longitudinal members are not fixed to the intermediate support members by welding as they were fixed thereto by welding conventionally, thermal deformation caused by welding can be prevented, the gaps t (the slits, openings) defined between the longitudinal members can be uniformly distributed and thus a screen plate 3 having an excellent performance can be obtained.

When one of the longitudinal members 33 is damaged in the state that the paper making screen plate 3 is used by being assembled to the screen 1, a job for replacing the longitudinal member 33 can be easily carried out.

Further, although the aforesaid embodiment describes a case that the paper making screen plate 3 includes one or two pieces of the intermediate support members interposed between the first support member 31 and the second support member 32, the present invention is not always limited thereto but the number of the intermediate support members may be suitably determined depending upon the length of the longitudinal members 33.

That is, n pieces ($n \geqq 3$), for example, three pieces of the intermediate support members, i.e., the first, second and third intermediate support members 351, 35111, 3511 are sequentially interposed between the first support member 31 and the second support member 32 from the first support member 31 side in FIG. 11 and these intermediate support members 351, 3511, 35111 have openings 361, 3611, 36111 for causing the longitudinal members 33 to pass therethrough and support the longitudinal members 33 by being abutted thereagainst.

The longitudinal members 33 are fixed to the first support member 31 at an end thereof and to the second support member 32 at the other end thereof by welding or the like, respectively and annularly disposed parallel with each other with gaps t defined therebetween.

A first interval keeping member 381 is interposed between the first support member 31 and the intermediate support member (in this embodiment, the first intermediate support member 351) next to the first support member 31, a second interval keeping member 391 (in this embodiment, the second intermediate support member 3511) is interposed between the second support member 32 and the intermediate interval keeping member next to the second support member 32, and (n−1) pieces of intermediate interval keeping members (in this embodiment, a first intermediate interval keeping member 401 is interposed between the second intermediate support member 351 and the third intermediate support member 35111 and a second intermediate interval keeping member 411 is interposed between the third intermediate support member 35111 and the second intermediate support member 3511) are interposed between the intermediate support member and the intermediate support member next to the above intermediate support member, respectively.

Note, a plurality (for example, 4 pieces) of the first interval keeping members 381 are disposed at intervals as shown in FIG. 4, and a plurality of the second interval keeping members 391, first intermediate interval keeping members 401 and second intermediate interval keeping members 411 are also disposed at predetermined intervals likewise.

To more surely achieve the abutted state, the recess 31B is formed to the first support member 31, the recess 351A is formed to the first intermediate support member 351 on the first support member 31 side thereof, the recess 351B is formed to the first intermediate support member 351 on the side opposite to the recess 351A, the recess 3511A is formed to the second intermediate support member 3511, the recess 3511B is formed to the second intermediate support member 3511 on the side opposite to the recess 3511A, a recess 35111A is formed to the third intermediate support member 35111, a recess 35111B is formed to the second intermediate support member 35111 on the side opposite to the recess 35111A, and the recess 32A is formed to the second support member 32, respectively.

Note, a plurality of the recesses 31B, recesses 351A, recesses 351B, recesses 35111A, recesses 35111B, recesses 3511A, recesses 3511B, and recesses 32A are formed in correspondence with the first interval keeping members 381, second interval keeping members 391, first intermediate interval keeping members 401, and second intermediate interval keeping members 411.

An end of the first interval keeping member 381 is engaged with the recess 31B of the first support member 31 and the other end thereof is engaged with the recess 351A of the first intermediate support member 351, an end of the first intermediate interval keeping member 401 is engaged with the recess 351B of the intermediate support member 351 and the other end thereof is engaged with the recess 35111A of the third intermediate support member 35111, an end of the second intermediate interval keeping member 411 is engaged with the recess 35111B of the third intermediate support member 35111 and the other end thereof is engaged with the recess 3511A of the second intermediate support member 3511, and an end of the second interval keeping member 391 is engaged with the recess 3511B of the second intermediate support member 3511 and the other end thereof is engaged with the recess 32A of the second support member 32, respectively.

As a result, the first interval keeping member 381, the (n−1) pieces of the intermediate interval keeping members (in this embodiment, the first intermediate interval keeping member 401 and second intermediate interval keeping member 411) and the second interval keeping member 391 support the n pieces (n≧3) of the intermediate support members (in this embodiment, the three pieces of the intermediate support members, i.e. first, third and second intermediate support members 351, 35111, 3511) to regulate the movement thereof.

Consequently, according to this embodiment, since the first interval keeping member 381, the (n−1) pieces of the intermediate interval keeping members (in this embodiment, the first intermediate interval keeping member 401 and second intermediate interval keeping member 411) and the second interval keeping member 391 support the n pieces (n≧3) of the intermediate support members (in this embodiment, the three pieces of the intermediate support member, i.e. first, third and second intermediate support members 351, 35111, 3511) to regulate the movement thereof and the longitudinal members are not fixed to the intermediate support members by welding as they were fixed thereto by welding conventionally, thermal deformation caused by welding can be prevented, the gaps t (slits, openings) defined between the longitudinal members 33 can be uniformly distributed and a paper making screen plate 3 having an excellent performance can be obtained. Further, when one of the longitudinal members 33 is damaged in the state that the paper making screen plate 3 is used by being assembled to the screen 1, a job for replacing the longitudinal member 33 can be easily carried out.

According to the invention of the full aspect, since the intermediate support member is held between the first support member and the second support member and the longitudinal members are not fixed to the intermediate support member by welding as they were fixed thereto by welding conventionally, thermal deformation caused by welding can be prevented and the gaps (slits, openings) defined between the longitudinal members can be uniformly distributed and thus the paper making screen plate having the excellent performance can be obtained. Further, when one of the longitudinal members is damaged in the state that the paper making screen plate is used by being assembled to the screen, a job for replacing the longitudinal member can be easily carried out because the intermediate support member is held between the first support member and the second support member and the longitudinal members are not fixed to the intermediate support member by welding as they were fixed thereto by welding conventionally.

According to the invention of the second aspect, since the first intermediate support member is held between the first interval keeping member and the third interval keeping member and the second intermediate support member is held between the third interval keeping member and the second interval keeping member, respectively and the longitudinal members are not fixed to the intermediate support members by welding as they were fixed thereto by welding conventionally, thermal deformation caused by welding can be prevented and the gaps defined between the longitudinal members can be uniformly distributed and thus the paper making screen plate having the excellent performance can be obtained. Further, when one of the longitudinal members is damaged in the state that the paper making screen plate is used by being assembled to the screen, a job for replacing the longitudinal member can be easily carried out.

Further, according to the invention of the third aspect, since the n pieces (n≧3) of the intermediate support members are supported by the first interval keeping member, the (n−1) pieces of the intermediate interval keeping members and the second interval keeping member to regulate the movement thereof and the longitudinal members are not fixed to the intermediate support members by welding as they were fixed thereto by welding conventionally, thermal deformation caused by welding can be prevented and the gaps (slits, openings) defined between the longitudinal members can be uniformly distributed and thus the paper making screen plate having the excellent performance can be obtained. Further, when one of the longitudinal members is damaged in the state that the paper making screen plate is used by being assembled to the screen, a job for replacing the longitudinal member can be easily carried out.

What is claimed is:

1. A paper making screen plate, comprising:

first and second support members;

a plurality of longitudinal members each having an end fixed to said first support member and the other end fixed to said second support member, respectively and annularly disposed in parallel with each other with gaps defined therebetween;

an intermediate support member interposed between said first support member and said second support member, having openings for causing said longitudinal members to pass therethrough and supporting said longitudinal members by being abutted thereagainst;

a first interval keeping member having an end abutted against said first support member and the other end abutted against said intermediate support member, respectively; and a second interval keeping member having an end abutted against said intermediate support member and the other end abutted against said second support member, respectively, wherein said first interval keeping member and said second interval keeping member hold said intermediate support member therebetween to thereby regulate the movement of said intermediate support member.

2. A paper making screen plate according to claim 1, wherein an end of said first interval keeping member is engaged with a recess of said first support member and the other end thereof is engaged with a recess of said intermediate support member and an end of said second interval keeping member is engaged with a recess of said second support member and the other end thereof is engaged with a recess of said intermediate support member, respectively.

3. A paper making screen plate, comprising:

first and second support members;

a plurality of longitudinal members each having an-end fixed to said first support member and the other end fixed to said second support member, respectively and annularly disposed in parallel with each other with gaps defined therebetween;

first and second intermediate support members interposed between said first support member and said second support member, having openings for causing said longitudinal members to pass therethrough and supporting said longitudinal members by being abutted thereagainst;

a first interval keeping member having an end abutted against said first support member and the other end abutted against said first intermediate support member, respectively;

a third interval keeping member having an end abutted against said first intermediate support member and the other end abutted against said second intermediate support member; and a second interval keeping member having an end abutted against said second intermediate support member and the other end abutted against said second support member, wherein said first interval keeping member and said third interval keeping member hold said first intermediate support member therebetween and said third interval keeping member and said second interval keeping member hold said second intermediate support member, respectively to thereby regulate the movement of said first intermediate support member and the movement of said second intermediate support member.

4. A paper making screen plate according to claim 3, wherein an end of said first interval keeping member is engaged with a recess of said first support member and the other end thereof is engaged with a recess of said first intermediate support member, an end of said second interval keeping member is engaged with a recess of said second intermediate support member and the other end thereof is engaged with a recess of said second support member, and an end of said third interval keeping member is engaged with a recess of said first intermediate support member and the other end thereof is engaged with a recess of said second intermediate support member, respectively.

5. A paper making screen plate, comprising:

first and second support members;

a plurality of longitudinal members each having an end fixed to said first support member and the other end fixed to said second support member, respectively and annularly disposed in parallel with each other with gaps defined therebetween;

n pieces ($n \geqq 3$) of intermediate support members positioned between said first support member and said second support member, having openings for causing said longitudinal members to pass therethrough and supporting said longitudinal members by being abutted thereagainst as well as sequentially disposed from said first support member side;

a first interval keeping member having an end abutted against said first support member and the other end abutted against said intermediate support member next to said first support member;

a second interval keeping member having an end abutted against said second support member and the other end abutted against said intermediate support member next to said second support member; and (n–1) pieces of intermediate interval keeping members each having an end abutted against said intermediate support member and the other end abutted against said intermediate support member next to the said intermediate support member, wherein said first interval keeping member, the (n–1) pieces of said intermediate interval keeping members and said second interval keeping member support the n pieces ($n \geqq 3$) of said intermediate support members to thereby regulate the movement thereof.

* * * * *